US011034150B2

(12) United States Patent
Seki

(10) Patent No.: US 11,034,150 B2
(45) Date of Patent: Jun. 15, 2021

(54) INK JET HEAD AND INK JET PRINTER

(71) Applicant: TOSHIBA TEC KABUSHIKI KAISHA, Tokyo (JP)

(72) Inventor: Masashi Seki, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/781,397

(22) Filed: Feb. 4, 2020

(65) Prior Publication Data

US 2020/0298565 A1 Sep. 24, 2020

(30) Foreign Application Priority Data

Mar. 18, 2019 (JP) ..... JP2019-050104

(51) Int. Cl.
*B41J 2/14* (2006.01)
*B41J 2/16* (2006.01)
*B41J 2/01* (2006.01)

(52) U.S. Cl.
CPC ..... *B41J 2/1433* (2013.01); *B41J 2/01* (2013.01); *B41J 2/14* (2013.01); *B41J 2/14209* (2013.01); *B41J 2/1606* (2013.01); *B41J 2/1621* (2013.01)

(58) Field of Classification Search
CPC .... B41J 2/1433; B41J 2/14209; B41J 2/1606; B41J 2/14; B41J 2/01; B41J 2/1621
See application file for complete search history.

(56) References Cited

U.S. PATENT DOCUMENTS

2002/0047876 A1 4/2002 Irinoda et al.
2014/0085377 A1 3/2014 Takahashi
2015/0079358 A1* 3/2015 Gotou ..... C09D 11/322 428/195.1
2016/0333208 A1* 11/2016 Gotou ..... C09D 11/322
2017/0182770 A1* 6/2017 Gotou ..... B41J 2/1433

FOREIGN PATENT DOCUMENTS

JP 2001341314 A 12/2001
JP 2003136734 A 5/2003
JP 2005-205601 A 8/2005

OTHER PUBLICATIONS

Extended European Search Report dated Jul. 16, 2020 mailed in corresponding European Patent Application No. 20158264.0, 7 pages.

* cited by examiner

*Primary Examiner* — Yaovi M Ameh
(74) *Attorney, Agent, or Firm* — Kim & Stewart LLP

(57) ABSTRACT

An ink jet head includes a nozzle plate base including a plurality of nozzles. A liquid repellent film is formed on a surface of the nozzle plate base. The liquid repellent film comprises a polymeric compound formed of repeating units with a cyclic structure. A portion of the repeating units with the cyclic structure are ring-opened.

18 Claims, 6 Drawing Sheets

INK JET HEAD AND INK JET PRINTER

CROSS-REFERENCE TO RELATED APPLICATIONS

This application is based upon and claims the benefit of priority from Japanese Patent Application No. 2019-050104, filed on Mar. 18, 2019, the entire contents of which are incorporated herein by reference.

FIELD

Embodiments described herein relate generally to an ink jet head and an ink jet printer.

BACKGROUND

An ink jet head that ejects an ink droplet from a nozzle by pressurizing ink with a piezoelectric member or the like is known. Such an ink jet head may have a structure imparted with ink repellency so the ink will not adhere to a nozzle plate surface or the like. Methods for imparting ink repellency may include forming an ink repellent film containing fluorine-based resin on the nozzle plate surface.

DETAILED DESCRIPTION

Embodiments provide an ink jet head with preferable liquid repellency and an ink jet printer equipped with such an ink jet head.

In general, according to an embodiment, an ink jet head includes a nozzle plate base including a plurality of nozzles and a liquid repellent film on a surface of the nozzle plate base. The liquid repellent film comprises a polymeric compound formed of repeating units with a cyclic structure. A portion of the repeating units with the cyclic structure are ring-opened.

According to another embodiment, an ink jet printer is provided. The ink jet printer includes the ink jet head according to an embodiment and a medium conveyer.

1. Ink Jet Head 1-1. Configuration

Hereinafter, example embodiments will be described with reference to the drawings.

Figure 1:
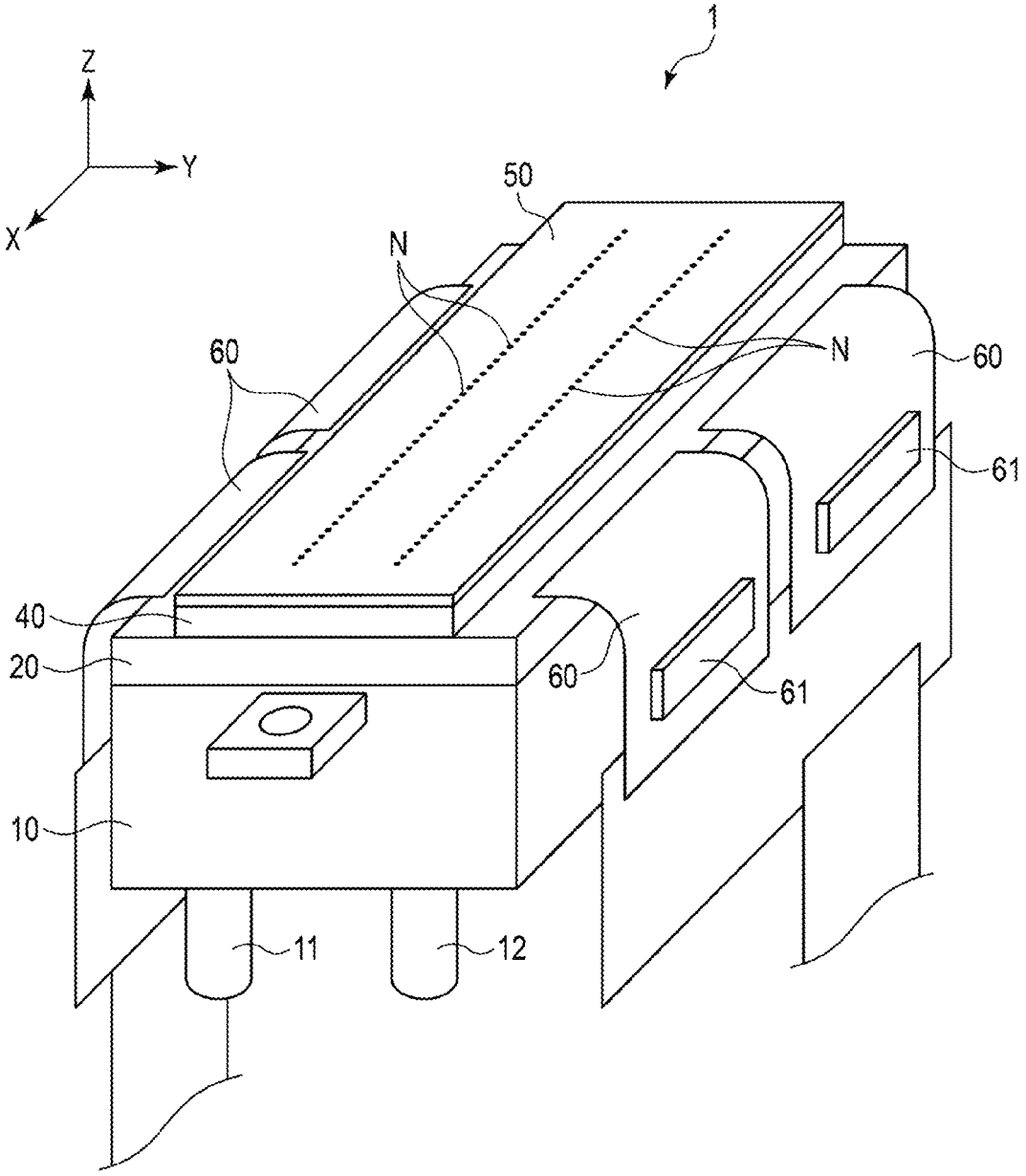
FIG. 1 illustrates a perspective view of an ink jet head according to an embodiment.

FIG. 1 illustrates a perspective view of an on-demand type ink jet head 1 that can be mounted on a head carriage of an ink jet printer according to an embodiment. In the following description, an orthogonal coordinate system including an X-axis, a Y-axis, and a Z-axis is used. For the sake of convenience, a direction indicated by an arrow in the figure is a positive direction. The X-axis direction corresponds to a print width direction. The Y-axis direction corresponds to a direction along which a recording medium, such as a sheet of paper, is conveyed. The plus Z-axis direction is a direction orthogonal to a surface of the recording medium.

As depicted in FIG. 1, the ink jet head 1 includes an ink manifold 10, an actuator plate 20, a frame 40, and a nozzle plate 50.

The actuator plate 20 has a rectangular shape whose longitudinal direction is the X-axis direction. Examples of the material of the actuator plate 20 include alumina ($Al_2O_3$), silicon nitride ($Si_3N_4$), silicon carbide (SiC), aluminum nitride (AlN), and lead zirconate titanate (PZT: $Pb(Zr,Ti)O_3$).

The actuator plate 20 is overlaid on the ink manifold 10 so as to close an open end of the ink manifold 10. The ink manifold 10 is connected to an ink cartridge via an ink supply pipe 11 and an ink return pipe 12.

The frame 40 is attached on the actuator plate 20. The nozzle plate 50 is attached on the frame 40. A plurality of nozzles N are provided on the nozzle plate 50 at predetermined intervals along the X-axis direction so as to form two rows along the Y-axis.

Figure 2:
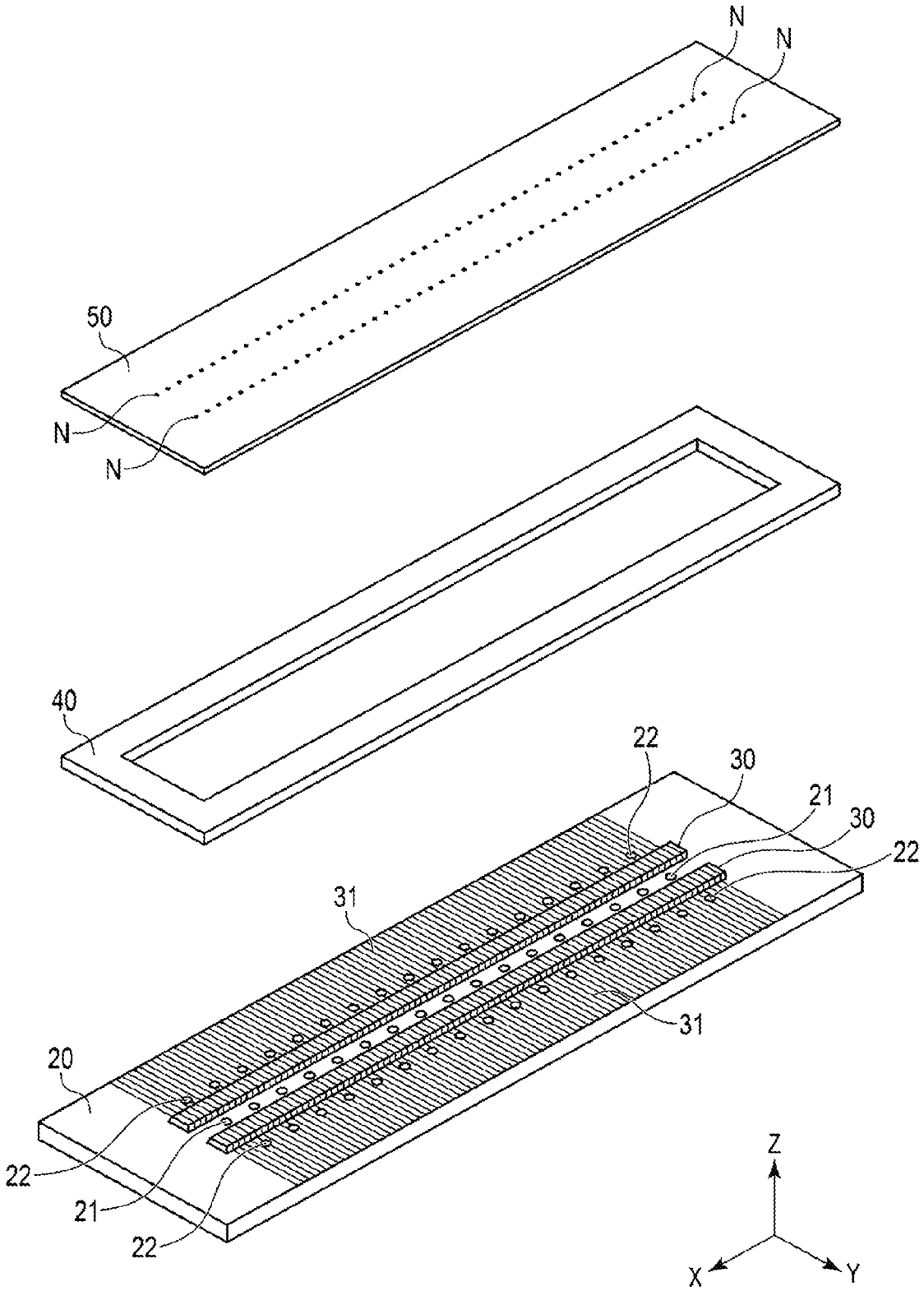
FIG. 2 illustrates an exploded perspective view of an actuator plate, a frame, and a nozzle plate in the ink jet head according to the embodiment.
Figure 3:
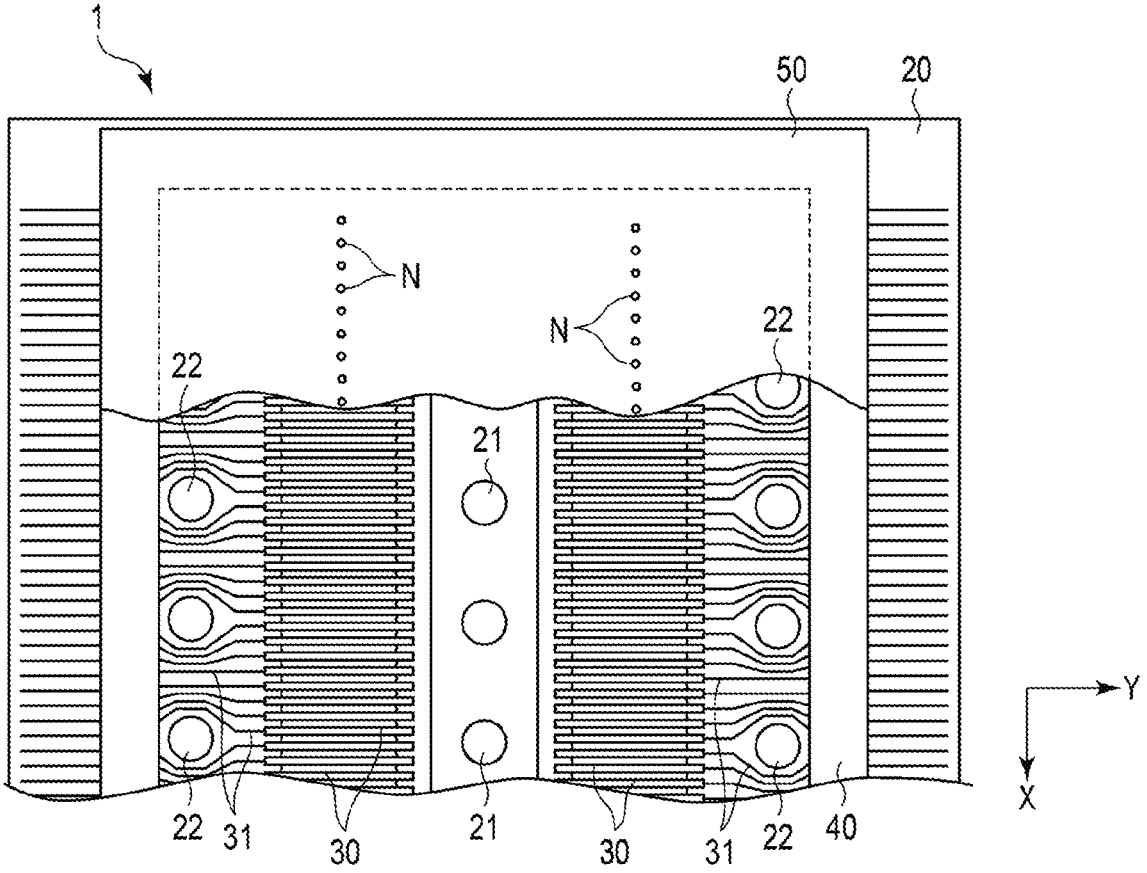
FIG. 3 illustrates a partially cut top view of the ink jet head according to the embodiment.
Figure 4:
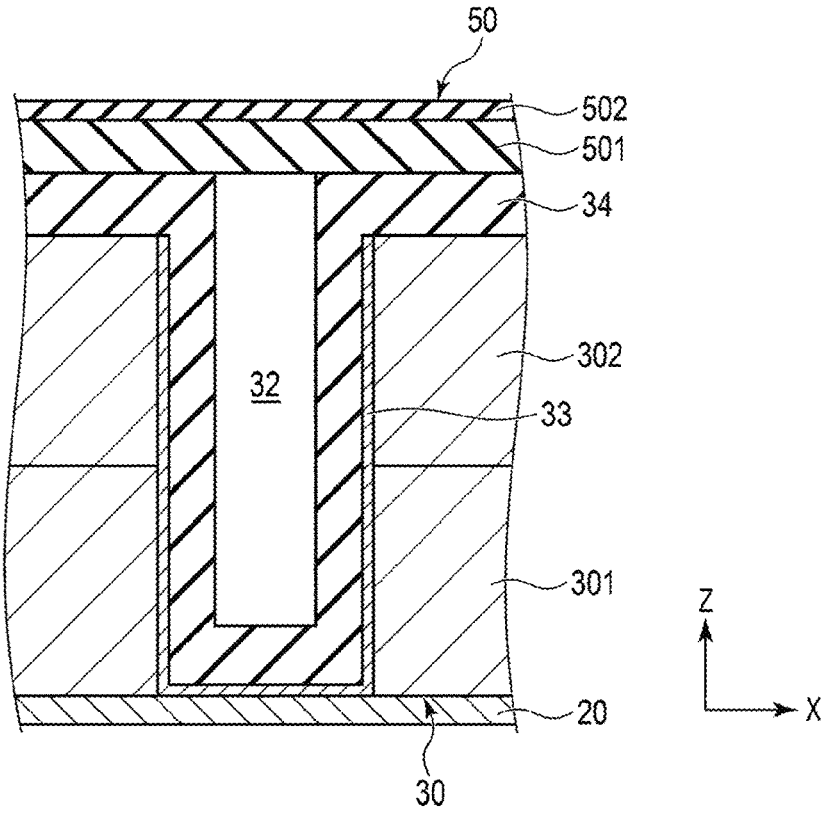
FIG. 4 illustrates a cross-sectional view of a part of the ink jet head illustrated in FIG. 3 along a plane perpendicular to a Y-axis in FIG. 3.

FIG. 2 illustrates an exploded perspective view of the actuator plate 20, the frame 40, and the nozzle plate 50 included in the ink jet head according to the embodiment. FIG. 3 illustrates a partially cut top view of the ink jet head according to the embodiment. FIG. 4 illustrates a cross-sectional view of a part of the ink jet head illustrated in FIG. 3 along a plane perpendicular to the Y-axis.

This ink jet head 1 is a side-shooter type of a so-called shear mode shared-wall type.

As illustrated in FIGS. 2 and 3, in the actuator plate 20, a plurality of ink supply ports 21 are provided at intervals along the X-axis direction so as to form a row at a central portion in the Y-axis direction. In the actuator plate 20, a plurality of ink discharge ports 22 are provided at intervals along the X-axis direction so as to respectively form rows in the plus Y-axis direction and the minus Y-axis direction with respect to the row of ink supply ports 21.

A plurality of piezoelectric members 30 are provided between the row of ink supply ports 21 provided at the central portion and one row of ink discharge ports 22. These piezoelectric members 30 form a row extending in the X-axis direction. The plurality of piezoelectric members 30 are also provided between the row of ink supply ports 21 provided at the central portion and the other row of ink discharge ports 22. These piezoelectric members 30 also form a row extending in the X-axis direction.

As illustrated in FIG. 4, each of the rows formed with the plurality of piezoelectric members 30 includes a first piezoelectric body 301 and a second piezoelectric body 302 laminated on the actuator plate 20. Examples of the material of the first piezoelectric body 301 and the second piezoelectric body 302 include lead zirconate titanate (PZT), lithium niobate ($LiNbO_3$), and lithium tantalate ($LiTaO_3$). The first piezoelectric body 301 and the second piezoelectric body 302 are polarized in opposite directions along the thickness direction.

In a laminate composed of the first piezoelectric body 301 and the second piezoelectric body 302, a plurality of grooves each extending in the Y-axis direction and arranged in the X-axis direction are provided. These grooves are open on the second piezoelectric body 302 side, and have a depth larger than the thickness of the second piezoelectric body 302. Hereinafter, portions of the laminate that are sandwiched between adjacent grooves are referred to as channel walls. Each of these channel walls extends in the Y-axis direction and is arranged in the X-axis direction.

The piezoelectric member 30 forms a pressure chamber 32 at a position communicating with a nozzle N described below and ejects ink in the pressure chamber 32 by changing pressure in the pressure chamber 32. The pressure chamber 32 through which ink circulates is a space positioned in the groove between two adjacent channel walls. The width of the pressure chamber 32, here, the dimension along the X-axis direction of the pressure chamber 32 is preferably in the range of 20 μm to 100 μm, and more preferably in the range of 50 μm to 80 μm.

An electrode 33 is formed on the side walls and the bottom surrounding the pressure chamber 32. That is, the electrode 33 is formed on a portion of the piezoelectric member 30 adjacent to the pressure chamber 32. These electrodes 33 are connected to wiring patterns 31 extending along the Y-axis direction. The electrode 33 applies the drive pulse to the piezoelectric member 30.

An electrode protective film 34 is formed on the surface of the actuator plate 20 including the electrode 33 and a wiring pattern 31 except for a connection portion used to make a connection to a flexible printed board described below. The electrode protective film 34 has an insulating property. The electrode protective film 34 is a film containing a polymeric compound having a polyparaxylylene backbone, for example.

The frame 40 has an opening as illustrated in FIGS. 2 and 3. The opening is smaller than the actuator plate 20 and larger than a region of the actuator plate 20 where the ink supply port 21, the piezoelectric member 30, and the ink discharge port 22 are provided. The frame 40 is made of ceramics, for example. The frame 40 is joined to the actuator plate 20 by an adhesive, for example.

The nozzle plate 50 is larger than the opening of the frame 40. The nozzle plate 50 is joined to the frame 40 by an adhesive, for example.

In the nozzle plate 50, a plurality of nozzles N that eject ink toward the recording medium are provided. These nozzles N form two rows corresponding to the pressure chambers 32. The nozzle N has a diameter that increases from the recording medium facing surface toward the pressure chamber 32. The dimension of the nozzle N is set to a predetermined value according to an ink ejection amount. The nozzle N can be formed, for example, by performing laser machining using an excimer laser.

The actuator plate 20, the frame 40, and the nozzle plate 50 are integrated as illustrated in FIG. 1, and form a hollow structure. A region surrounded by the actuator plate 20, the frame 40, and the nozzle plate 50 is an ink circulation chamber. Ink is circulated in such a way that ink is supplied from the ink manifold 10 to the ink circulation chamber through the ink supply port 21, passes through the pressure chamber 32 and excess ink returns from the ink discharge port 22 to the ink manifold 10. A part of the ink is ejected from the nozzle N while flowing through the pressure chamber 32 and is used for printing.

A flexible printed board 60 is connected to the wiring pattern 31 at a position outside the frame 40 on the actuator plate 20. A drive circuit 61 that drives the piezoelectric member 30 is mounted on the flexible printed board 60.

As illustrated in FIG. 4, the nozzle plate 50 includes a nozzle plate base material 501 and a liquid repellent film 502 provided on the recording medium facing surface, also referred to as the ejection surface. The nozzle plate base material 501 is made of a resin film such as a polyimide film, for example. The liquid repellent film 502 may also be provided on the back side surface of the nozzle plate base material 501.

The liquid repellent film 502 comprises a polymeric compound containing a repeating unit with a cyclic moiety. According to an example, the liquid repellent film 502 is primarily comprised of the polymeric compound containing the repeating unit with the cyclic moiety. A portion of the cyclic structures of the cyclic moieties have been ring-opened. In other words, the compound contained in the liquid repellent film 502 contains both (closed) cyclic portions and corresponding ring-opened portions. The closed and ring-opened portions can be are randomly arranged within the polymeric compound, for example.

The cyclic moiety preferably includes a fluorine atom thereon or therein. The cyclic structure can be an aliphatic ring, or preferably a fluorinated aliphatic ring. When the aliphatic ring is fluorinated, liquid repellency of the liquid repellent film 502 tends to increase. The cyclic structure is preferably a heterocyclic compound composed of carbon and oxygen, and more preferably, a heterocyclic compound including an ether bond (C—O—C). When the cyclic structure contains an ether bond, the liquid repellency of the liquid repellent film 502 tends to increase.

The polymeric compound with a repeating unit that contains the cyclic moiety structure is preferably a fluororesin, more preferably an amorphous fluororesin. When a fluororesin is used, the liquid repellency of the liquid repellent film 502 tends to increase.

A repeating unit containing a cyclic moeity is represented by the following chemical formula (1), for example. As one example compound having the following chemical formula (1) as the repeating unit, for example, CYTOP® manufactured by AGC Inc. can be used. The cyclic structure contained in the repeating unit may be a 5-membered ring or a structure other than a 5-membered ring.

[Chemical Formula (1)]

(1)

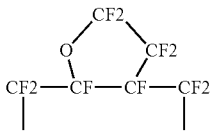

In the liquid repellent film 502, a portion of the cyclic structures represented by the chemical formula (1) has been ring-opened. The corresponding ring-opened structure for chemical formula (1) is represented, for example, by the following chemical formula (2). In chemical formula (2), an end (terminal) of the ring-opened chain can be modified to include a substituent R thereon or thereat. R is, for example, a hydroxyl (OH) group. The two substituent Rs illustrated in the chemical formula (2) may be the same or different from each other. The compound in the liquid repellent film 502 may be a co-polymer in which units of chemical formula (1) and units of chemical formula (2) are randomly arranged.

[Chemical Formula 2]

(2)

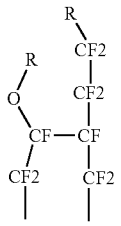

Confirmation that the liquid repellent film 502 contains the repeating unit and that the repeating unit contains the cyclic structure can be obtained by, for example, nuclear magnetic resonance (NMR) analysis and mass (MS) analysis.

Confirmation that only a portion of the cyclic structures in the liquid repellent film 502 have been ring-opened can be obtained by, for example, X-ray photoelectron spectroscopy (XPS). Specifically, by comparing areas of peaks which characteristically belong to bonds in the cyclic structures in an XPS spectrum of a liquid repellent film in which all of the cyclic structures are unopened to areas of those peaks in an XPS spectrum of a liquid repellent film in which all of the cyclic structures have been ring-opened, then an XPS spectrum of a liquid repellent film in which a only a portion of the cyclic structures have been ring-opened can be observed and the portion estimated.

That is, in an XPS spectrum of a liquid repellent film in which a portion of the cyclic structures have been ring-opened, the peak area I1 corresponding to a bond contained in the cyclic structure is smaller than a peak area 12 of corresponding to the same bond in an XPS spectrum of a liquid repellent film in which none of the cyclic structures have been ring-opened, but will be larger than a peak area I3 corresponding to the same bond in an XPS spectrum of a liquid repellent film in which all of the cyclic structures have been ring-opened. In other words, when the peak area I1 is smaller than the peak area I2 but larger than the peak area I3, it can be said that some portion of the cyclic structures in the liquid repellent film 502 have been ring-opened.

Figure 5:
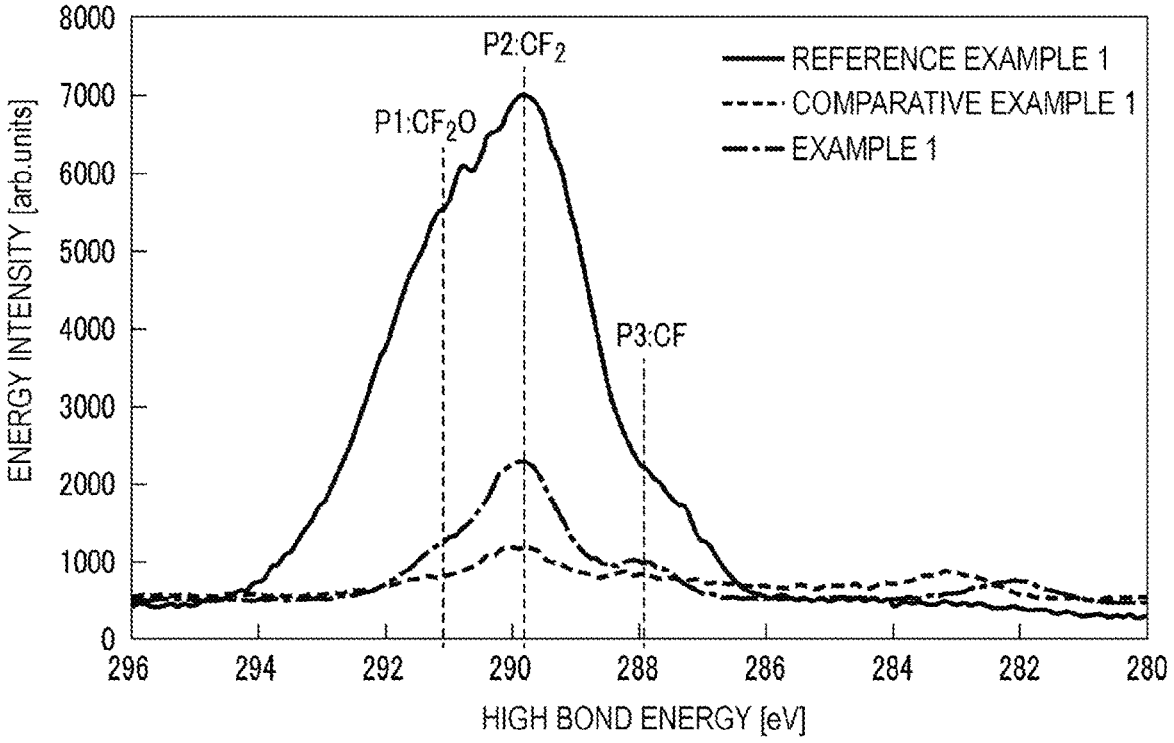
FIG. 5 is a graph illustrating an example of an XPS spectrum according to Example 1, Comparative Example 1, and Reference Example 1.

Here, an example case in which a compound containing the repeating unit represented by the chemical formula (1) is used for a liquid repellent film 502 will be described. FIG. 5 is a graph illustrating XPS spectra for Example 1, Comparative Example 1, and Reference Example 1. FIG. 5 is an XPS spectrum relating to C1s. In FIG. 5, Example 1 is a liquid repellent film containing a compound in which some of the repeating units represented by the chemical formula (1) have been ring-opened, Reference Example 1 is a liquid repellent film containing a compound in which none of the repeating units represented by the chemical formula (1) have been ring-opened, and Comparative Example 1 is a liquid repellent film containing a compound in which all of the repeating units represented by the chemical formula (1) have been ring-opened.

The repeating unit represented by the chemical formula (1) contains a $CF_2O$ bond, a $CF_2$ bond, and a CF bond in its cyclic structure. As illustrated in FIG. 5, in an XPS spectrum, the peak P1 belonging to the $CF_2O$ bond appears on the high bond energy side within the range of 1 eV or more and 1.3 eV or less than bond energy of the peak P2 belonging to the $CF_2$ bond. The peak P3 belonging to the CF bond appears on the low bond energy side within the range of 1.7 eV or more and 2 eV or less than the bond energy of the peak P2 belonging to the $CF_2$ bond.

The peak P1 belonging to the $CF_2O$ bond is an indicator that the liquid repellent film has a cyclic structure. Accordingly, when a ratio A1/A2 between an area A1 of the peak P1 and an area A2 of the peak P2 is greater than 0 but is less than or equal to 0.8, it can be said that some of the cyclic structures in the liquid repellent film have been ring-opened. That is, when the ratio A1/A2 is greater than 0.8, it can be said that none of the cyclic structures of the compounds in the liquid repellent film are ring-opened. When the ratio A1/A2 is 0, it can be said that all of the cyclic structures of the compounds in the liquid repellent film have been ring-opened. Peak areas of the peaks P1, P2, and P3 are obtained by performing peak separation on the XPS spectrum relating to C1s.

The film thickness of the liquid repellent film 502 is preferably 10 nm to 200 nm. When the film thickness of the liquid repellent film 502 is within this range, good liquid repellency can be maintained over a long period.

1-2. Ink Ejection

Hereinafter, the operation of the piezoelectric member 30 will be described with reference to FIGS. 3 and 4. Here, the operation will be described assuming that the pressure chambers 32 are also formed on both sides of the central pressure chamber 32. It is assumed that the electrodes 33 corresponding to the three adjacent pressure chambers 32 are electrodes A, B and C, respectively, and the electrode 33 corresponding to the central pressure chamber 32 is the electrode B.

In order to eject ink from a nozzle N corresponding to the central pressure chamber 32, first, for example, a voltage pulse having higher potential than potentials of the adjacent electrodes A and C is applied to the central electrode B to generate an electric field in a direction perpendicular to the channel wall. Thus, the channel walls are driven in the shear mode and a pair of channel walls sandwiching the central pressure chamber 32 is deformed so that the central pressure chamber 32 expands.

Next, a voltage pulse having higher potential than the potential of the central electrode B is applied to both adjacent electrodes A and C to generate an electric field in a direction perpendicular to the channel wall. Thus, the channel walls are driven in the shear mode and the pair of channel walls sandwiching the central pressure chamber 32 is deformed so that the central pressure chamber 32 is reduced. By this operation, pressure is applied to ink in the central pressure chamber 32 and the ink is ejected from the nozzle N corresponding to the pressure chamber 32 to land on the recording medium. Thus, in the ink jet head 1, ink is ejected from the nozzle N using the piezoelectric member 30 as an actuator.

In the printing process using the ink jet head 1, for example, all the nozzles N are divided into three groups and the driving operation described above is performed in a time-sharing manner for three cycles to perform printing on the recording medium.

1-3. Manufacturing Method

Next, a method for manufacturing the ink jet head 1 illustrated in FIGS. 1 to 4 will be described.

First, as illustrated in FIGS. 2 and 3, a structure in which the piezoelectric member 30 is provided on the actuator plate 20 is formed by a method known in the related art. Next, as illustrated in FIGS. 2 to 4, the wiring pattern 31 and the electrode 33 are formed on the piezoelectric member 30 and the actuator plate 20 by, for example, plating. Next, as illustrated in FIG. 4, the electrode protective film 34 is formed on the electrode 33 and a portion of the second piezoelectric body 302 that is not covered with the electrode 33 by, for example, a chemical vapor deposition (CVD) method. Next, as illustrated in FIG. 2, the frame 40 is attached to the upper surface of the actuator plate 20 through an adhesive.

Next, the nozzle plate 50 including the liquid repellent film 502 is prepared. Specifically, first, the nozzle plate base material 501 is prepared. The nozzle plate base member 501 includes a hole to serve as a nozzle. When the hole to be a nozzle is provided after the liquid repellent film 502 is formed, the nozzle plate base material 501 having no holes may be used.

A liquid repellent film material-containing liquid is coated onto one main surface of the nozzle plate base material 501 to form a coating film. As a method for forming the coating film, for example, a spin coating method or an immersion method is used. The coating film may be formed on both surfaces of the nozzle plate 501. Prior to coating the liquid repellent film material-containing liquid, the surface of the nozzle plate base material 501 may be subjected to pretreatment. Examples of the pretreatment include silane coupling agent coating, plasma treatment, and the like. When such pretreatment is performed, the adhesion between the nozzle plate base material 501 and the liquid repellent film 502 can be enhanced.

The liquid repellent film material-containing liquid may contain the compound containing the repeating unit that contains the cyclic structure and a solvent capable of dissolving the compound. The liquid repellent film material-containing liquid contains, for example, a fluorine-based organic material and a fluorine-based organic solvent capable of dissolving the fluorine-based organic material. The compound contained in the fluorine-based organic material may be capable of forming a polymer having a structure, which includes a cyclic structure formed at a specific temperature (so-called cyclic-bond temperature), as a repeating unit. As the fluorine-based organic material, A-type CYTOP® manufactured by AGC Inc. may be used.

This coating film is subjected to heating treatment to form the liquid repellent film. In the heating treatment, the heating temperature is set to a cyclic-bond temperature or higher, preferably 100° C. to 200° C., and the heating time is more preferably 30 minutes to 2 hours. In the liquid repellent film immediately after film formation, it is considered that substantially none of the cyclic structures in the compounds have been ring-opened.

Next, the nozzle plate base material 501 is attached to the frame 40 through an adhesive so that the main surface has the liquid repellent film faces outward and the nozzle N and the pressure chamber 32 communicate with each other. Next, the attached nozzle plate base material 501 and frame 40 are heated at a temperature of 100° C. to 180° C. for several hours, for example. With this configuration, the nozzle plate base material 51 is bonded to the frame 40.

Through a series of treatments including this heating treatment, all of the cyclic structures contained in the repeating units in the liquid repellent film are ring-opened. The liquid repellent film in which all of the cyclic structures have been ring-opened has significantly lower liquid repellency than that of the liquid repellent film immediately after film formation (that is, before ring-opening of the cyclic structures).

Next, reheating treatment is performed on the liquid repellent film. In the reheating treatment, the heating temperature is set to be equal to or higher than the cyclic-bond temperature. The heating temperature is preferably in a range of 120° C. to 210° C. It is preferable that the heating time in this reheating treatment is in a range of 30 minutes to 2 hours. Next, the liquid repellent film after the reheating treatment is cooled until reaching a temperature of 40° C. or lower, for example. By this reheating treatment and cooling treatment, a part of the ring-opened cyclic structures in the liquid repellent film are reverted back to the cyclic structures again. With this configuration, the liquid repellent film 502 containing a compound containing a cyclic structure as a repeating unit, of which a part of these cyclic structures in the repeating units have been ring-opened, is obtained.

In the cooling, it is preferable to gradually cool the liquid repellent film at a rate in the range of 0.4° C./min to and 3° C./min until a temperature of, for example, 40° C. or less is reached. By gradually cooling, the liquid repellency of the liquid repellent film 502 can be further enhanced.

The ink jet head 1 according to the embodiment can be manufactured by the method as described above.

2. Ink Jet Printer 2.1 Configuration

Figure 6:
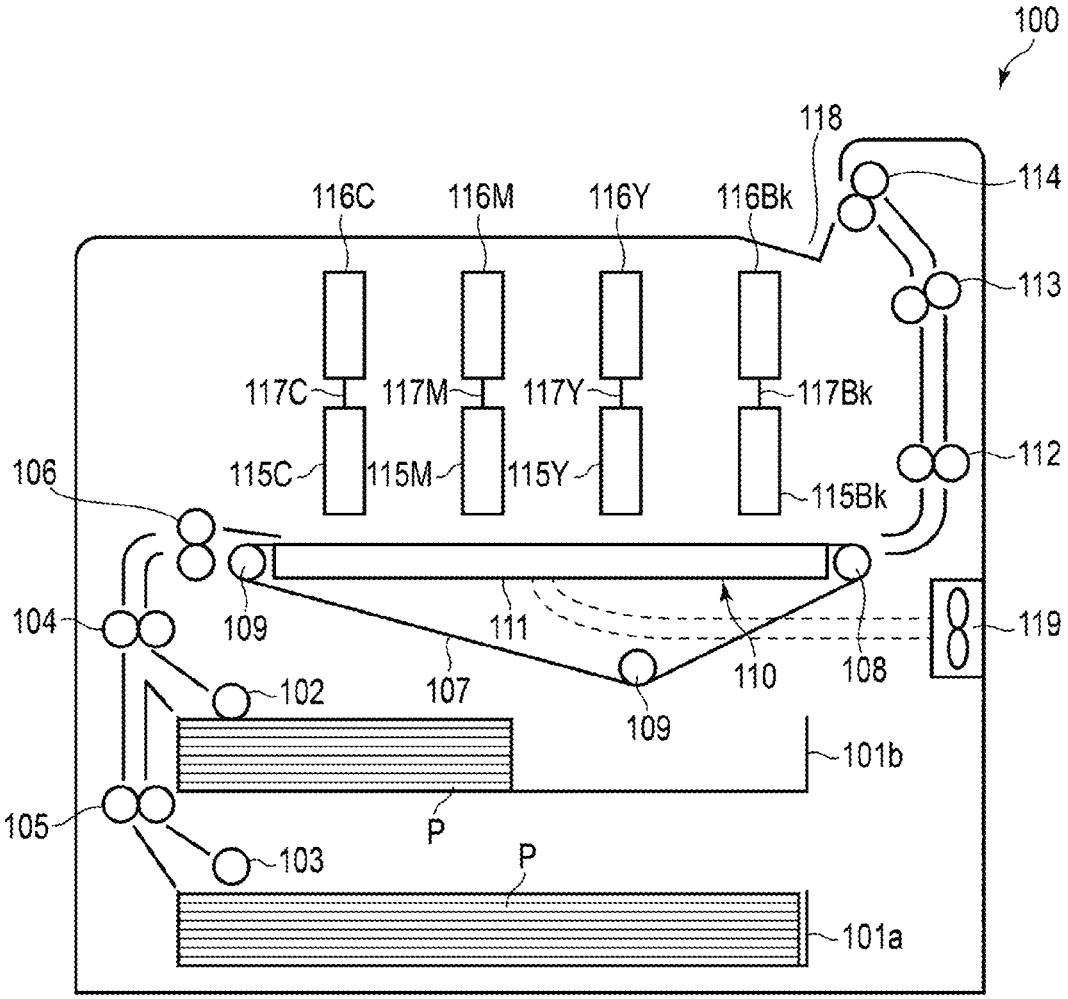
FIG. 6 is a schematic diagram illustrating an ink jet printer according to the embodiment.

In FIG. 6, a schematic diagram of an ink jet printer 100 is illustrated.

The ink jet printer 100 according to the embodiment includes ink jet heads 115C, 115M, 115Y, and 115Bk, and a medium holding mechanism 110 that holds the recording medium facing the ink jet heads 115C, 115M, 115Y, and 115Bk. Each of the ink jet heads 115C, 115M, 115Y, and 115Bk is the ink jet head 1 described with reference to FIGS. 1 and 2.

The ink jet printer 100 illustrated in FIG. 6 includes a casing having a paper discharge tray 118. In the casing, cassettes 101*a* and 101*b*, paper feed rollers 102 and 103, conveyance roller pairs 104 and 105, a registration roller pair 106, a conveyance belt 107, a fan 119, a negative pressure chamber 111, conveyance roller pairs 112, 113, and 114, ink jet heads 115C, 115M, 115Y, and 115Bk, ink cartridges 116C, 116M, 116Y, and 116Bk, and tubes 117C, 117M, 117Y, and 117Bk are provided.

The cassettes 101*a* and 101*b* accommodate recording media P of different sizes. The paper feed roller 102 or 103 picks up the recording medium P corresponding to the size of a selected recording medium from the cassette 101*a* or 101*b* and conveys the recording medium P to the conveyance roller pairs 104 and 105 and the registration roller pair 106.

The conveyance belt 107 is tensioned by a driving roller 108 and two driven rollers 109. Holes are provided on the surface of the conveyance belt 107 at predetermined intervals. The negative pressure chamber 111 connected to the fan 119 for adsorbing the recording medium P to the conveyance belt 107 is provided inside the conveyance belt 107. The conveyance roller pairs 112, 113, and 114 are provided downstream of the conveyance belt 107 in the conveyance direction. A heater for heating a print layer formed on the recording medium P can be provided in a conveyance path from the conveyance belt 107 to the paper discharge tray 118.

Above the conveyance belt 107, four ink jet heads that eject ink onto the recording medium P according to image data are disposed. Specifically, an ink jet head 115C that ejects cyan (C) ink, an ink jet head 115M that ejects magenta (M) ink, an ink jet head 115Y that ejects yellow (Y) ink, and an ink jet head 115Bk that ejects black (Bk) ink are disposed in this order from the upstream side.

Above the ink jet heads 115C, 115M, 115Y, and 115Bk, a cyan (C) ink cartridge 116C, a magenta (M) ink cartridge 116M, a yellow (Y) ink cartridge 116Y, and a black (Bk) ink cartridge 116Bk that respectively contain inks corresponding to the ink jet heads 115C, 115M, 115Y, and 115Bk are provided. These ink cartridges 116C, 116M, 116Y, and 116Bk are connected to the ink jet heads 115C, 115M, 115Y, and 115Bk by the tubes 117C, 117M, 117Y, and 117Bk, respectively.

Although not illustrated, the ink jet printer 100 may include a heater for heating the liquid repellent film on the nozzle plates of the ink jet heads 115C, 115M, 115Y, and 115Bk. When liquid repellency of the liquid repellent film of the ink jet head is lowered, the liquid repellency of the liquid repellent film can be restored by reheating the liquid repellent film.

2-2. Image Formation

Next, an image forming operation of the ink jet printer 100 will be described.

First, an image processing unit starts image processing for recording, generates an image signal corresponding to image data, and generates a control signal for controlling operations of various rollers, the negative pressure chamber 111, and the like.

Under the control of the image processing unit, the paper feed roller 102 or 103 picks up the recording medium P of the selected size one by one from the cassette 101*a* or 101*b* and conveys the recording medium P to the conveyance roller pair 104 or 105 and the registration roller pair 106. The registration roller pair 106 corrects skew of the recording medium P and conveys the recording medium P at a predetermined timing.

The negative pressure chamber 111 sucks air through the holes of the conveyance belt 107. Accordingly, the recording medium P is sequentially conveyed to positions below the ink jet heads 115C, 115M, 115Y, and 115Bk as the conveyance belt 107 moves in a state of being attracted to the conveyance belt 107.

The ink jet heads 115C, 115M, 115Y, and 115Bk eject ink in synchronization with the timing at which the recording medium P is conveyed under the control of the image processing unit. With this configuration, a color image is formed at a desired position on the recording medium P.

Thereafter, the conveyance roller pairs 112, 113, and 114 discharge the recording medium P on which the image is formed to the paper discharge tray 118. When a heater is provided in the conveyance path from the conveyance belt 107 to the paper discharge tray 118, the print layer formed on the recording medium P may be heated by the heater. When heating with the heater is performed, particularly, when the recording medium P is impermeable, adhesion of the print layer to the recording medium P can be improved.

3. Effect

The ink jet head 1 described above includes the liquid repellent film 502 containing the compound which contains a repeating unit containing a cyclic structure and some portion of the repeating units have the cyclic structure ring-opened. According to such a configuration, excellent liquid repellency can be achieved. This is considered in this instance to be due to the reason(s) described below.

As described above, in the manufacturing process of the ink jet head 1, all of the cyclic structures may be ring-opened and become branches of chain-type structures. However, when the cyclic structures are thus all ring-opened, the liquid repellency of the liquid repellent film is significantly reduced.

The ink jet head according to the embodiment includes a liquid repellent film in which only a portion of the cyclic structures of the repeating units are ring-opened. That is, only some portion of repeating units are ring-opened and thus the remaining portion retain (or have) the closed (unopened) cyclic structure. Accordingly, the ink jet head according to the embodiment achieves excellent liquid repellency as compared with the ink jet head including the liquid repellent film in which all of the cyclic structures are ring-opened.

In the manufacturing method described above, not all of the branches formed by allowing the cyclic structure to be ring-opened will revert back to form the cyclic structure in the reheating treatment and the cooling treatment.

Some of the branches that do not form the cyclic structure may react with functional groups on the surface of the nozzle plate base material 501. With this configuration, adhesion of the nozzle plate base material 501 and the liquid repellent film 502 can be improved.

The cyclic structure in the compound contained in the liquid repellent film is considered to be a portion that exhibits good liquid repellency. That is, the liquid repellent film can exhibit better liquid repellency by exposing the cyclic structure portion to the external surface at which ink can come into contact. Other branches that do not form the cyclic structure may prevent the re-formed cyclic structure(s) from rotating around the main chain and help prevent the cyclic structure portion from moving from the external surface to the inside of the liquid repellent film. With this configuration, the ink jet head according to the embodiment can maintain excellent liquid repellency over a long period of time.

EXAMPLES

Examples will be described below.

Reference Example 1

First, a fluorine-based resin-containing liquid in which fluorine-based resin was dissolved in a fluorine-based solvent was prepared. As the fluorine-based resin, A-type CYTOP® manufactured by AGC Inc. was used.

Next, using a spin coating method, the fluorine-based resin-containing liquid was coated onto the surface of the nozzle plate base material and the coating film was subjected to heating treatment. In the heating treatment, the heating treatment temperature was 180° C. and the heating treatment time was 30 minutes. A polyimide film was used as the nozzle plate base material.

In this way, a nozzle plate including a liquid repellent film containing a compound having a cyclic structure was obtained. The film thickness of the liquid repellent film was 200 nm.

Example 1

The ink jet head 1 was manufactured by the method described above using the nozzle plate obtained by the method of Reference Example 1. In the reheating treatment, the heating temperature was 205° C. and the heating time was 2 hours. The cooling treatment was performed at a rate of 1.5° C./min until reaching 40° C.

In this way, an ink jet head including a liquid repellent film containing a compound in which a part of the cyclic structure was ring-opened was obtained.

Comparative Example 1

An ink jet head was manufactured by the same method as in Example 1 except that the reheating treatment and the cooling treatment were omitted.

In this way, an ink jet head including a liquid repellent film containing a compound in which all of the cyclic structures were ring-opened was obtained.

XPS Analysis

For the liquid repellent film of the ink jet head manufactured in Example 1 and Comparative Example 1 and the liquid repellent film of the nozzle plate obtained in Reference Example 1, the XPS spectrum was measured by the method described above. FIG. 5 described above illustrates the result.

Liquid Repellency Evaluation

For the nozzle plate of the ink jet head according to Example 1 and Comparative Example 1 and the nozzle plate according to Reference Example 1, the time required for the nozzle plate to repel ink was measured.

First, ink was prepared. A water-based ink was used as the ink.

Next, the nozzle plate was held vertical at an upper end portion thereof, and substantially the entire nozzle plate was immersed into the ink. The upper end of the immersed nozzle plate was pulled up from the ink by a length of 60 mm, and the time required for the ink to disappear from the pulled up portion was measured. The result is illustrated in FIG. 7.

Figure 7:
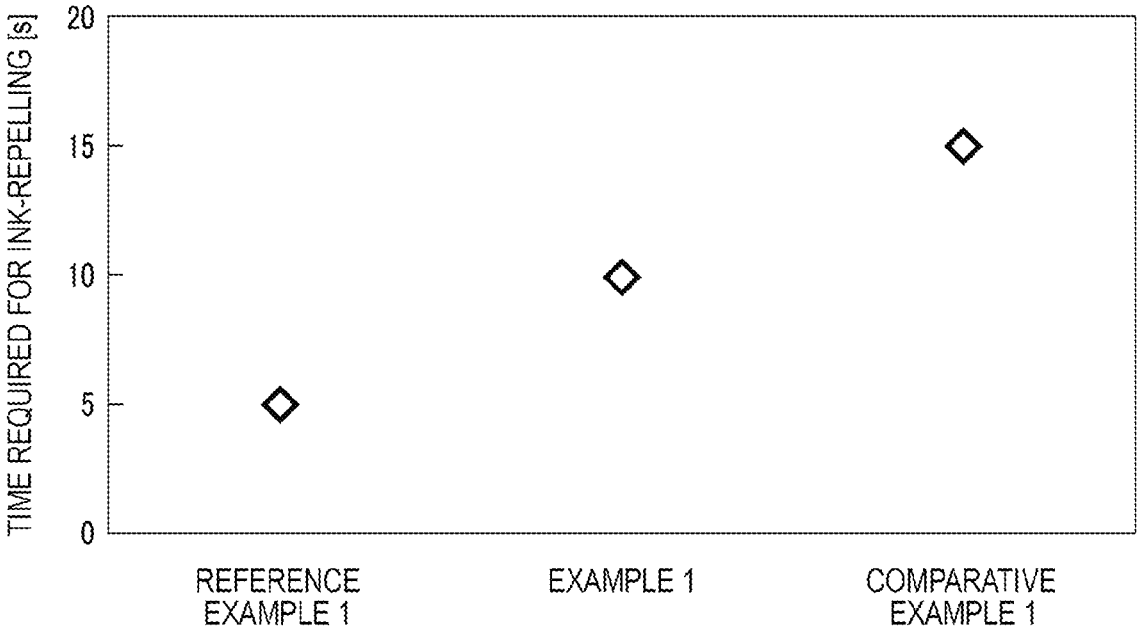
FIG. 7 is a graph illustrating ink repellency according to Example 1, Comparative Example 1, and Reference Example 1.

FIG. 7 is a graph illustrating the time for repelling the ink of the nozzle plates according to Example 1, Comparative Example 1, and Reference Example 1. As illustrated in FIG. 7, the liquid repellency of the nozzle plate according to Example 1 was higher than the liquid repellency of the nozzle plate according to Comparative Example 1.

The ink jet head according to at least one embodiment as described above includes a repellent film containing a compound which contains a repeating unit containing a cyclic structure and in which a part of the cyclic structure is ring-opened. Accordingly, the ink jet head according to the embodiment can achieve excellent liquid repellency.

While certain of embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An ink jet head, comprising:

a nozzle plate base including a plurality of nozzles; and a liquid repellent film on a surface of the nozzle plate base, wherein the liquid repellent film comprises a polymeric compound formed of repeating units with a cyclic structure, and a portion of the repeating units with the cyclic structure are ring-opened, forming a ring-opened chain having a hydroxyl group on an end thereof; and wherein the cyclic structure is represented by the chemical formula:

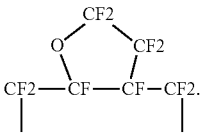

2. The ink jet head according to claim 1, wherein the repeating unit includes a fluorine atom.

3. The ink jet head according to claim 1, wherein the cyclic structure is an aliphatic ring.

4. The ink jet head according to claim 1, wherein the cyclic structure is heterocyclic.

5. The ink jet head according to claim 1, wherein the cyclic structure is a 5-membered ring.

6. The ink jet head according to claim 1, wherein the liquid repellent film is 200 nm or less in thickness.

7. The ink jet head according to claim 1, wherein the polymeric compound is a fluororesin.

8. The ink jet head according to claim 1, wherein the polymeric compound is an amorphous fluororesin.

9. The ink jet head according to claim 1, wherein the polymeric compound is a random co-polymer of repeating units with the cyclic structure and repeating units with the cyclic structure ring-opened.

10. A printer, comprising:

a recording media conveyer; and an ink jet head configured to eject an ink onto a medium conveyed by the recording media conveyer, the ink jet head comprising:

a nozzle plate base including a plurality of nozzles from which the ink is ejected; and a liquid repellent film on a surface of the nozzle plate base, wherein the liquid repellent film comprises a polymeric compound formed of repeating units with a cyclic structure, and a portion of the repeating units with the cyclic structure are ring-opened, forming a ring-opened chain having a hydroxyl group on an end thereof; and wherein the cyclic structure is represented by the chemical formula:

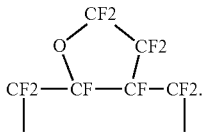

11. The printer according to claim 10, wherein the repeating unit includes a fluorine atom.

12. The printer according to claim 10, wherein the cyclic structure is an aliphatic ring.

13. The printer according to claim 10, wherein the cyclic structure is heterocyclic.

14. The printer according to claim 10, wherein the cyclic structure is a 5-membered ring.

15. The printer according to claim 10, wherein the liquid repellent film is 200 nm or less in thickness.

16. The printer according to claim 10, wherein the polymeric compound is a fluororesin.

17. The printer according to claim 10, wherein the polymeric compound is an amorphous fluororesin.

18. The printer according to claim 10, wherein the polymeric compound is a random co-polymer of repeating units with the cyclic structure and repeating units with the cyclic structure ring-opened.

* * * * *